US006155003A

United States Patent [19]

Smith

[11] Patent Number: 6,155,003

[45] Date of Patent: Dec. 5, 2000

[54] VEHICLE STORAGE BUILDING

[76] Inventor: Clark W. Smith, 522 S. 13th St., Decatur, Ind. 46733

[21] Appl. No.: 09/385,472

[22] Filed: Aug. 30, 1999

[51] Int. Cl.[7] ..... E04B 1/346

[52] U.S. Cl. ..... 52/65

[58] Field of Search ..... 52/65, 174; 414/242, 414/243, 241; 244/114 R

[56] References Cited

U.S. PATENT DOCUMENTS

| | | | |
|---|---|---|---|
| 1,855,534 | 4/1932 | Williams | 52/65 |
| 2,964,144 | 12/1960 | Wheeler | 52/65 |
| 3,398,843 | 8/1968 | Smith | 52/65 |
| 3,599,809 | 8/1971 | Gresham | 414/242 |
| 3,670,464 | 6/1972 | Cutter | 52/65 |
| 3,675,378 | 7/1972 | Neumann et al. | 52/65 |
| 3,730,359 | 5/1973 | Andersson | 414/242 |
| 3,815,298 | 6/1974 | Pope | 52/65 |
| 3,842,941 | 10/1974 | Gerber | 52/65 X |
| 3,915,319 | 10/1975 | Fairburn | 414/242 |
| 4,697,392 | 10/1987 | Silzle | 52/65 |
| 5,755,160 | 5/1998 | Blufordcraving | 52/65 X |

*Primary Examiner*—David M. Purol
*Attorney, Agent, or Firm*—Krieg DeVault Lundy, LLP

[57] ABSTRACT

A vehicle storage building having upstanding side walls and a single door opening providing access to the interior of the building. The building having upwardly facing and generally planar interior vehicle support surface on which the vehicle may be stored and a turntable adjacent the door having at least one vehicle stall thereon flush with the airplane support surface. The building has both the one stall on the turntable and a plurality of storage positions within the building remote from the turntable from which stored vehicles may be taken from or delivered to the storage positions by way of the turntable through the door without repositioning any of the other vehicles within the building.

18 Claims, 13 Drawing Sheets

82,84
120
118
116
106
102
104
108
100

82
88
92
124
86
90
74

157
112
15
76
126
82
160
72
174
44
136
80
124
74
68
66
146
172
170
126
84
114
100
124
128
134
60
54
148
150
152
144
158
157
154
156
58
78
61
62

VEHICLE STORAGE BUILDING

BACKGROUND OF THE INVENTION

The present invention relates to an improved vehicle storage building, and more specifically to an improved hangar for aircraft which can be built, maintained and used for less cost that conventional hangars.

Heretofore, the most inexpensive and widely used hangar for aircraft has been the so-called T-type hangar. The popularity of T-type hangars has been primarily due to the relatively low cost and the relatively efficient use of space within such a hangar. However, T-type hangars require doors on opposite sides of the hangar, ramps and taxi strips adjacent thereto since the aircraft are stored alternately to face the opposite sides of the hangar and are removed from the hangar nose first. For this reason, T-type hangars even when arranged in the most favorable manner require many more doors and additional ramps and taxi strips as a hangar would require if all of the aircraft could be removed from the same the side of the hangar.

It is therefore highly desirable to provide a new and improved vehicle storage building. It is also highly desirable to provide a new and improved hangar for aircraft which is simple in construction and inexpensive in use. It is also highly desirable to provide a new and improved aircraft hangar which requires no ramps or taxi strips. It is also highly desirable to provide a new and improved aircraft hangar which requires less doors, and no ramps and taxi strips as do the popular T-type hangar. It is also highly desirable to provide a new and improved aircraft hangar in which all of the aircraft could be removed from the same side of the hangar.

However, no simply constructed and relatively inexpensive hangar has ever been proposed which (1) allows all the aircraft stored in the hangar to be removed from the same side of the hangar, (2) requires fewer doors than other hangars and no ramps or taxi strips and (3) utilizes hangar space and land more efficiently than a T-type hangar. It is therefore highly desirable to provide a new and improved aircraft hangar in which all of the aircraft stored in the hangar can be removed from the same side of the hangar. It is also highly desirable to provide a new and improved aircraft hangar which provides airplane storage more efficiently than a T-type hangar. It is also highly desirable to provide a new and improved aircraft hangar which can be used to store all conventional gear and tricycle gear aircraft which utilizes hangar space and land more efficiently than a conventional T-type hangar. It is also highly desirable to provide a new and improved aircraft hangar which requires fewer hangar doors and no ramps and taxi strips. It is also highly desirable to provide a new and improved aircraft hangar which stores the aircraft allowing the aircraft to be stored within and removed from the hangar without requiring the moving of adjacent aircraft. Whenever aircraft have to be shuffled about within a hangar, experience indicates that sooner or later the aircraft will become damaged by colliding with adjacent aircraft. This likelihood of such damage or "hangar rash" is normally reflected in the cost of insuring aircraft. Conventionally, insurance rates fluctuate depending upon the type of hangar used to store the insured aircraft; and thus, in addition to facilitating the removal of a single aircraft from the hangar and probably reducing the labor cost involved in running an airport, the use of such a hangar will decrease the cost of insuring aircraft stored therein.

It is still further desirable to provide an improved hangar which can be relatively inexpensively manufactured and erected and which will allow airports more efficiently to use available land thereby permitting airports to provide hangar facilities without necessitating a relatively large capital expenditure. A hangar which allows all of the aircraft stored in the hangar to be removed from the same side of the hangar would require significantly less ground area required by T-type hangars and eliminate the need for ramps and taxi strips, and would allow the more efficient use of airport land as such hangars can be arranged to back up to airport property boundaries, fences, walls, building or similar limits to land use, and be closer to airport fueling facilities and administration offices.

Additionally, it is still further desirable to provide a new hangar design by which the standard multi-plane hangars built in the 1920-30's can be renovated to hold some or all of the features mentioned above.

Finally, it is highly desirable to provide a new and improved vehicle storage building having all of the above features.

SUMMARY OF THE INVENTION

It is therefore an object of the invention to provide a new and improved vehicle storage building.

It is also an object of the invention to provide a new and improved hangar for aircraft which is simple in construction and inexpensive in use.

It is also an object of the invention to provide a new and improved aircraft hangar which requires no ramps or taxi strips.

It is also an object of the invention to provide a new and improved aircraft hangar which requires less doors, and no ramps or taxi strips as do the popular T-type hangar.

It is also an object of the invention to provide a new and improved aircraft hangar in which all of the aircraft could be removed from the same side of the hangar.

It is also an object of the invention to provide a new and improved aircraft hangar in which all of the aircraft stored in the hangar can be removed from the same side of the hangar.

It is also an object of the invention to provide a new and improved aircraft hangar which provides airplane storage more efficiently than a Ttype hangar.

It is also an object of the invention to provide a new and improved aircraft hangar which can be used to store all conventional gear and tricycle gear aircraft which utilizes hangar space and land more efficiently than a conventional T-type hangar.

It is also an object of the invention to provide a new and improve aircraft hangar which requires fewer hangar doors and no ramps and taxi strips.

It is also an object of the invention to provide a new and improved aircraft hangar which stores the aircraft allowing the aircraft to be stored within and removed from the hangar without requiring the moving of adjacent aircraft.

It is also an object of the invention to provide an improved hangar which can be relatively inexpensively manufactured and erected and which will allow airports more efficiently to use available land thereby permitting airports to provide hangar facilities without necessitating a relatively large capital expenditure.

It is also an object of the invention to provide an improved hangar construction which utilizes hangar space at least as efficiently as convention T-type hangars and which permits each aircraft stored within the hangar to be positioned within and removed from the hangar through an opening in the same side of the hangar thereby minimizing the number of doors and taxi strip required and permitting the hangar to be positioned backed up to a peripheral boundary of the property on which the hangar is located or other buildings.

It is also an object of the invention to provide an improved hangar construction which more efficiency utilizes ground space available for hangars.

It is also an object of the invention to provide an improved hangar construction comprising a rotatable aircraft support upon which several aircraft can be stored in spaced relation thereby providing that each of the aircraft can be loaded and unloaded from the support through a common hangar opening whereby both hangar doors and taxi strip will be minimized.

It is also an object of the invention to provide an improved hangar construction comprising a rotatable aircraft support upon which several aircraft can be stored in spaced relation and which is directly connected solely to a rigid vertical post passing through the center thereof.

It is also an object of the invention to provide a new hangar design by which the standard multi-plane hangars built in the 1920-30's can be renovated to have some or all of the features mentioned above.

Finally, it is an object of the invention to provide a new and improved vehicle storage building having all of the above features.

In the broader aspects of the invention there is provided a vehicle storage building having upstanding side walls and a single door opening providing access to the interior of the building. The building has upwardly facing and generally planar interior vehicle support surface on which the vehicle may be stored and a turntable adjacent the door having at least one vehicle stall thereon flush with the airplane support surface. The building has both the one stall on the turntable and a plurality of storage positions within the building remote from the turntable from which stored vehicles may be taken from or delivered to the storage positions by way of the turntable through the door without repositioning any of the other vehicles within the building.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
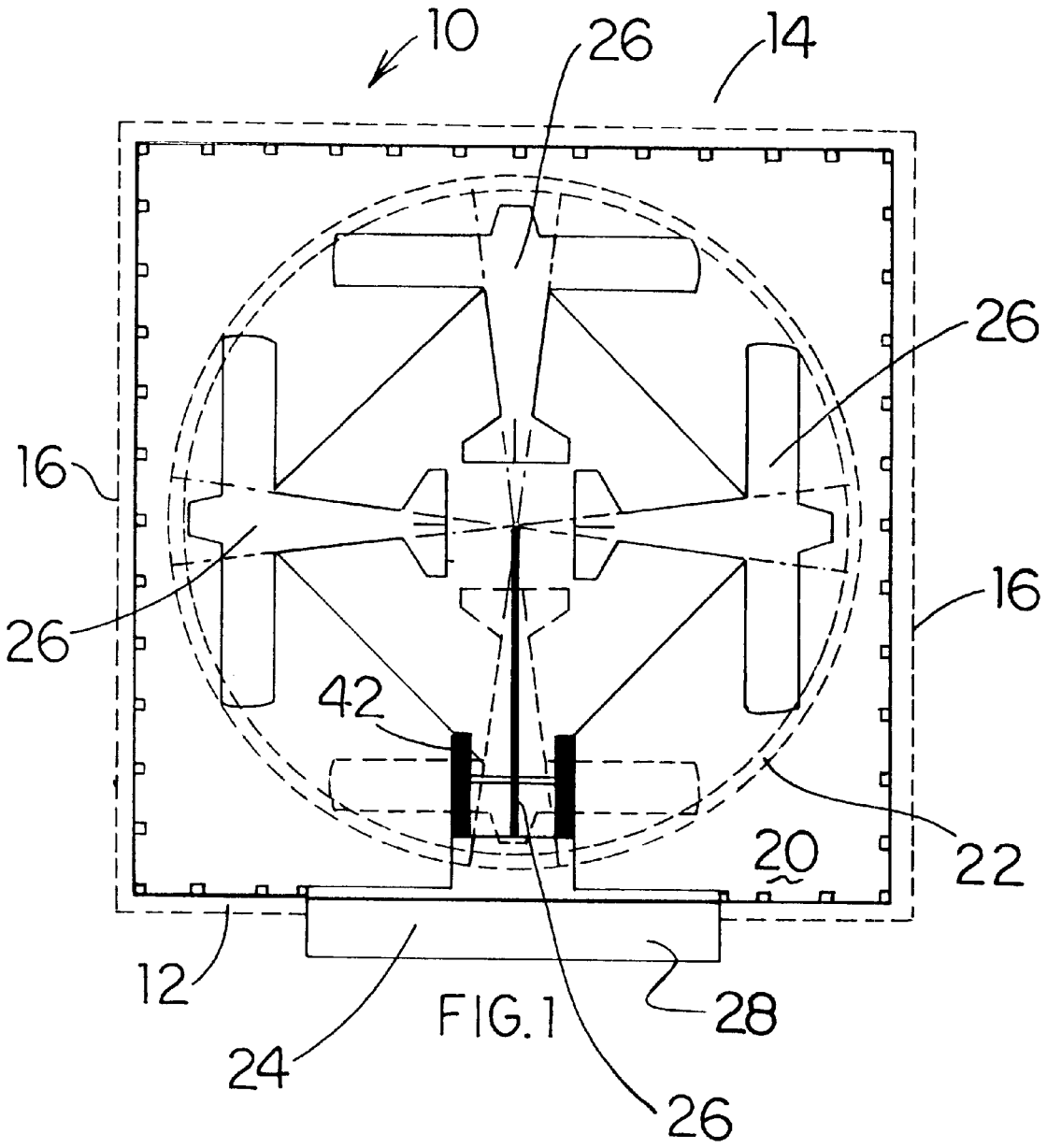
FIG. 1 is a top plan view of the new and improved vehicle storage building of the invention showing the exterior walls of the hangar, the door opening, and a four plane carousel adjacent the door opening.
Figure 2:
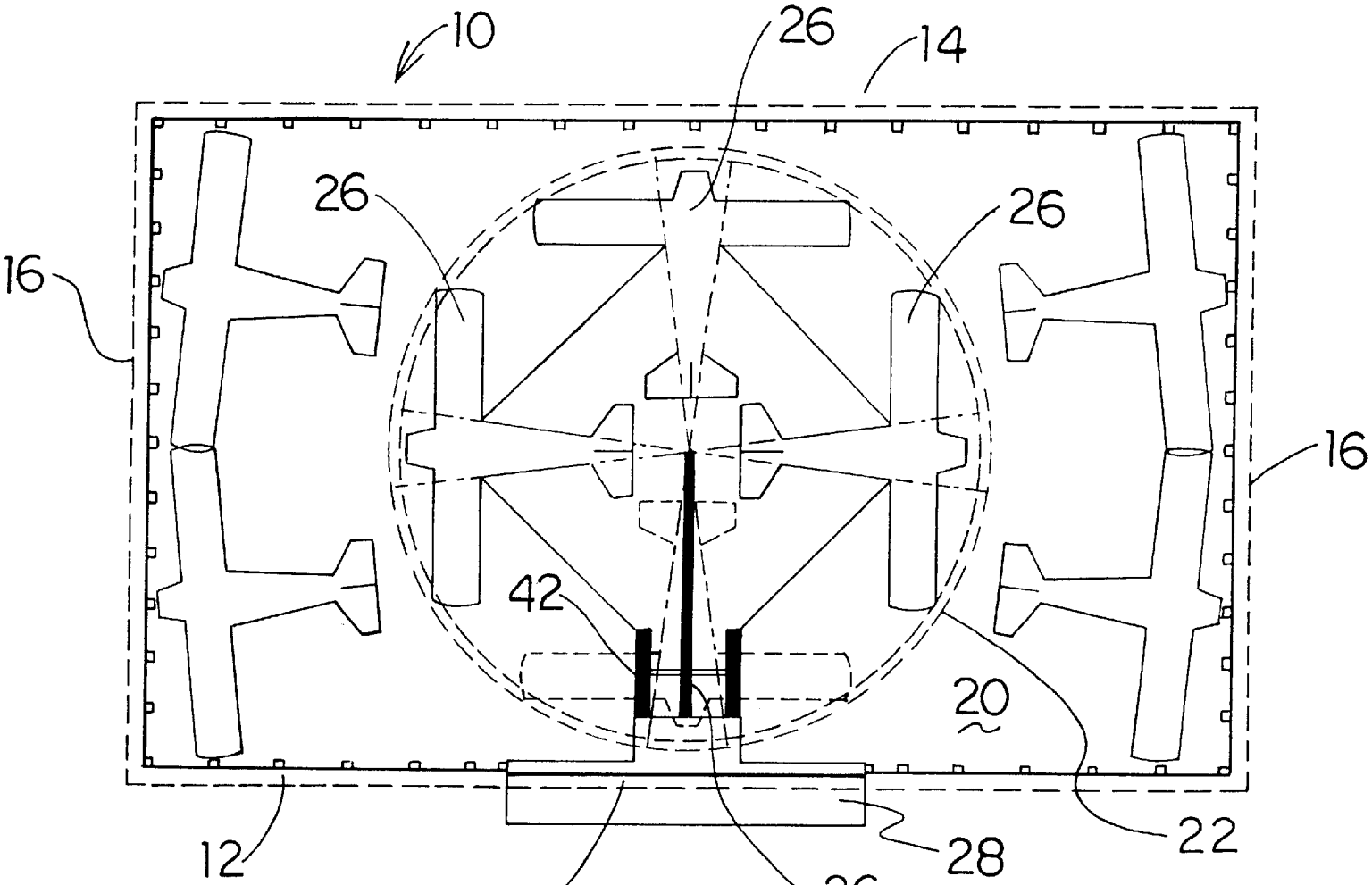
FIG. 2 is a top view like FIG. 1 of the new and improved vehicle storage building of the invention using the carousel and having seven plane capacity.

Referring to FIGS. 1 and 2, there is shown a top view of the new and improved vehicle storage building 10 of the invention having a front wall 12, a rear wall 14 and end walls 16 each upstanding. The building is either positioned on ground 20 leveled prior to construction or on a floor elevated above the ground as desired. A carousel 22 is positioned between the front wall 12 and rear walls 14 and equally positioned between the end walls 16. A door 24 is positioned in the front wall 12 equal distance between the ends 16.

Figures 12, 14, 15:
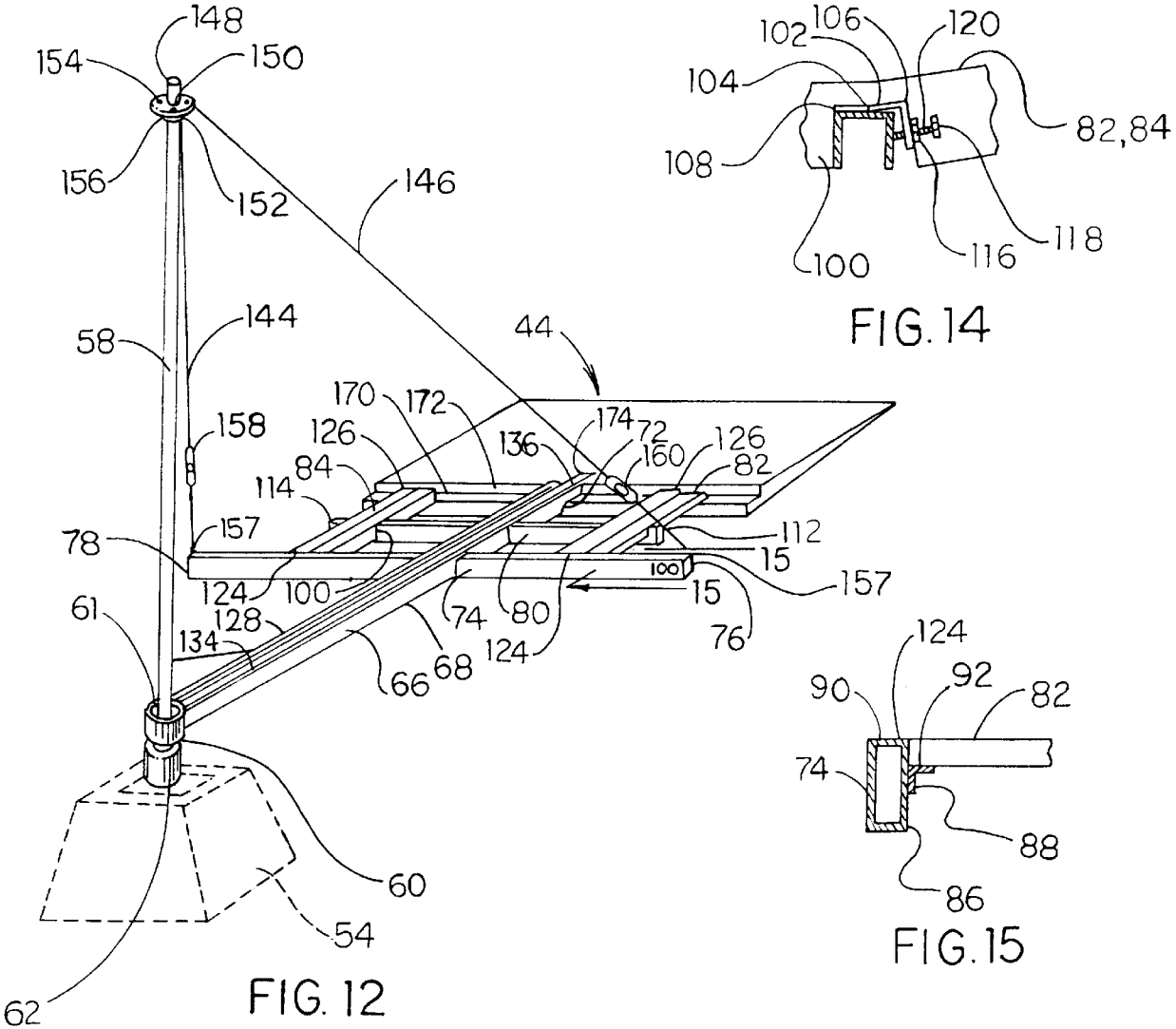
FIG. 12 is a perspective fragmentary view of the aircraft support illustrated in FIGS. 8–11 showing one of the airplane stalls of the support positioned in registry with the ramp associated therewith.
FIG. 14 is a fragmentary end view of the adjustment means illustrated in FIG. 13 taken substantially along the section line 14—14 in FIG. 13.
FIG. 15 is a fragmentary and cross-sectional view of the means by which on end of the aircraft wheel-supporting members are supported taken substantially along the section line 15—15 of FIG. 12.
Figure 13:
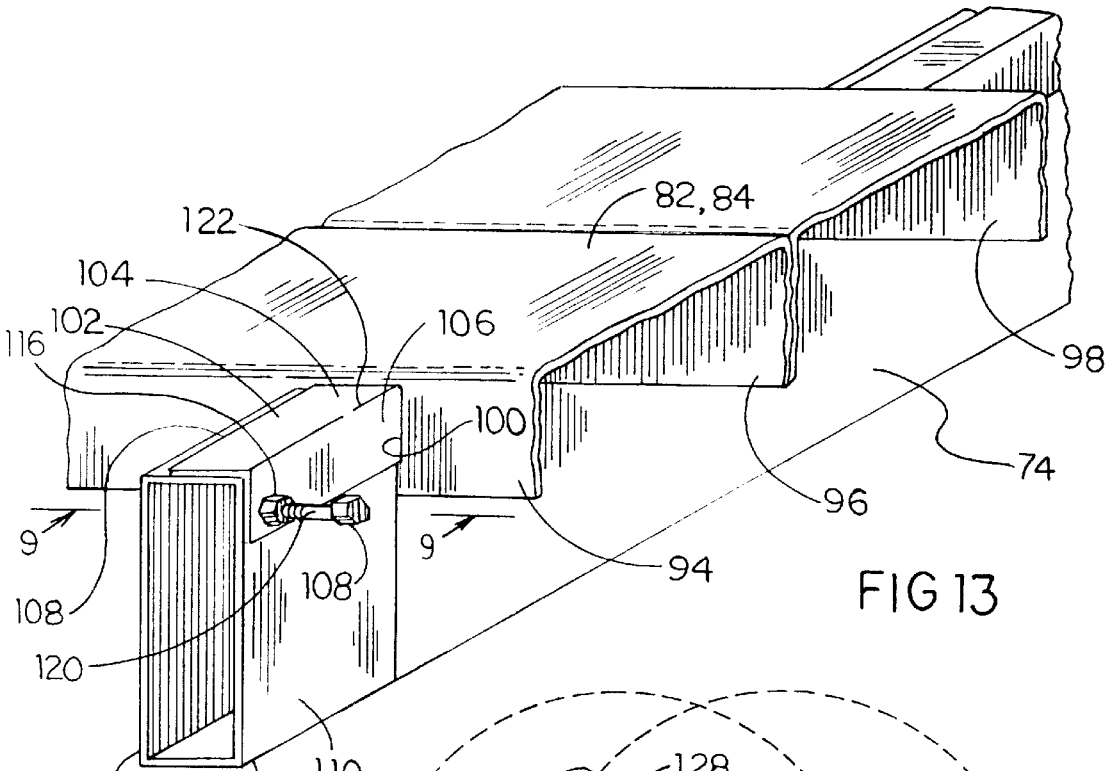
FIG. 13 is a fragmentary, perspective view of the means by which the most distal end of the aircraft support can be adjusted in height.
Figure 19:
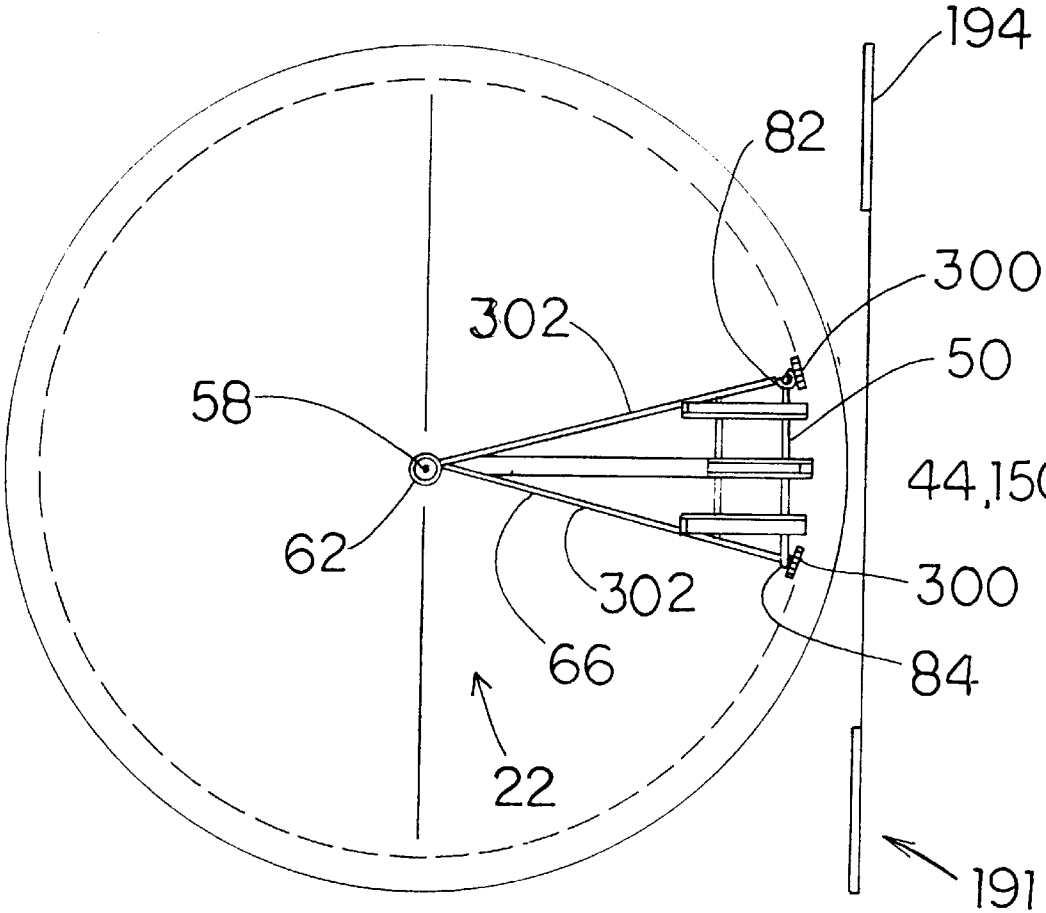
FIG. 19 is a fragmentary top view of a modified version of a single airplane stall to be used with any of the buildings of the invention.

The carousel 22 may include a plurality of airplane stalls 26 thereon as shown in FIGS. 1–11 or only a single airplane stall thereon as shown in FIGS. 12 and 19. Each of the airplane stalls 26 however may be identical and will be described hereinafter. Each of the airplane stalls 26 are flush with the floor or ground 20, such that aircraft can be rolled from the floor or ground 20 onto an airplane stall 26 when desired and removed therefrom by rolling the aircraft off the carousel 22 onto the floor 20 or through the door 24 onto the taxi strip or runway 28.

Figure 3:
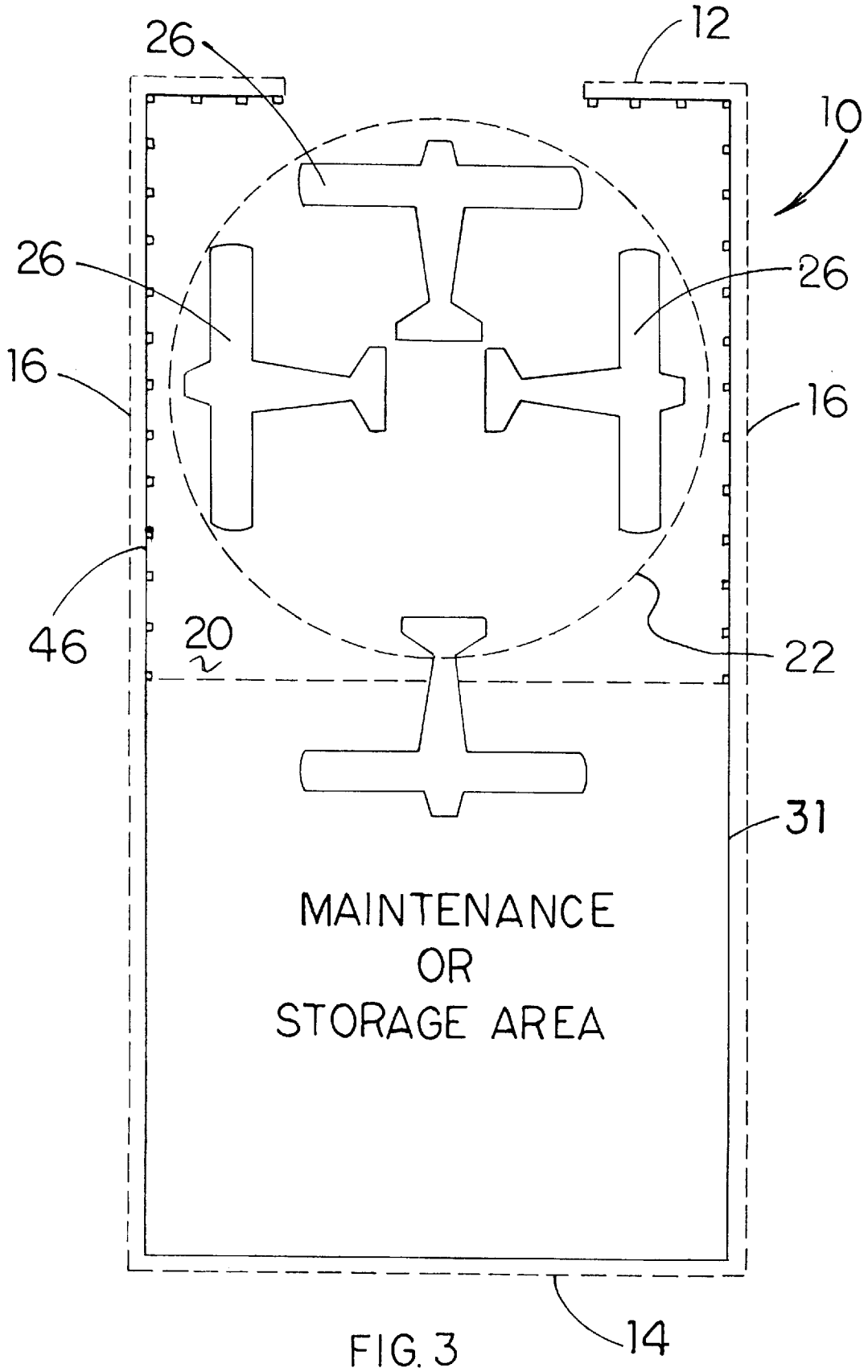
FIG. 3 is a view like FIGS. 1 and 2 of another modified version of the new and improved vehicle storage building of the invention using a four plane carousel having a four plane hangar capacity with a maintenance or storage area therebehind by which single aircraft can be moved for maintenance or moved for use without disturbing the other aircraft.
Figure 4:
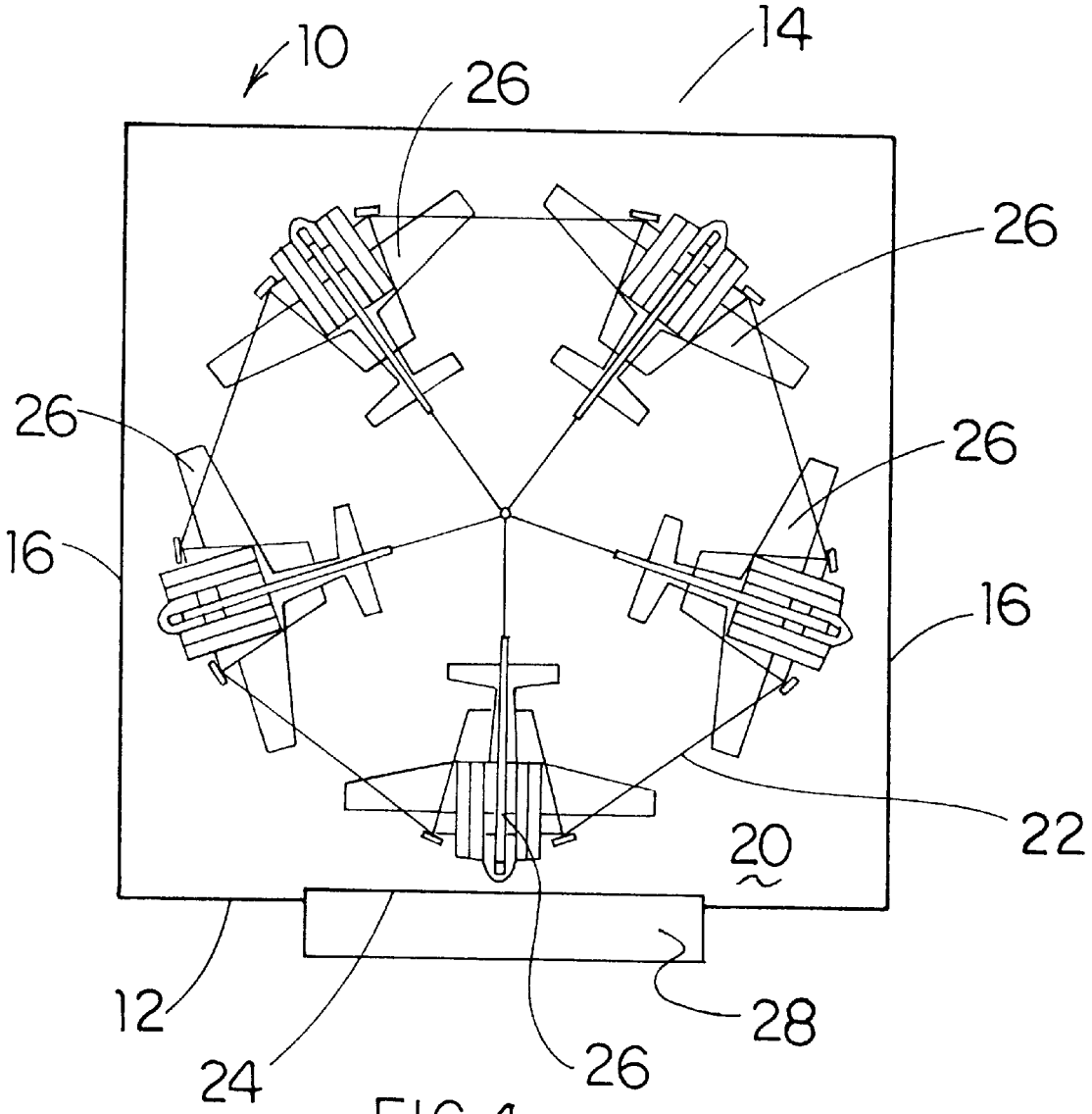
FIG. 4 is a top planar view of a five plane carousel of the invention.
Figure 5:
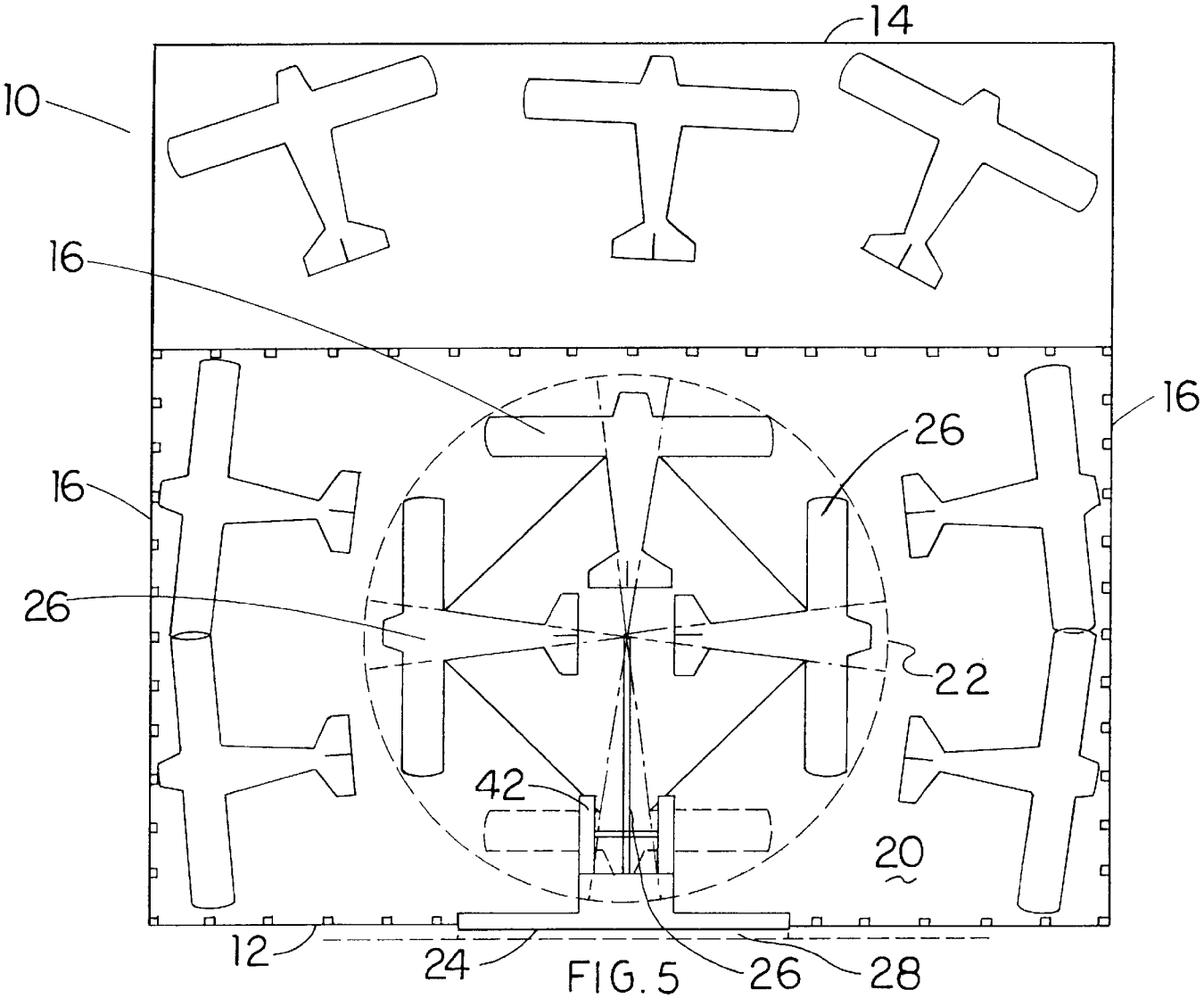
FIG. 5 is front elevational view of the exterior of a modified version of the new and improved vehicle storage building of the invention using a four plane carousel and having a capacity of eleven planes.

FIG. 2 shows the new and improved vehicle storage building 29 having a capacity of seven to eight aircraft. FIG. 5 shows the new and improve vehicle storage building 30 of the invention having a ten to eleven plane capacity. FIG. 3 shows a new and improved vehicle storage building 31 of the invention showing a three to four plane capacity with a maintenance or storage area attached. Each of these building versions may have a four plane carousel 22 as shown in FIGS. 1–3 and 5–11, a five plane carousel 22 as shown in FIG. 4 or a one plane carousel 66 as shown in FIGS. 12 and 19. In each of these versions of the new and improved vehicle storage building of the invention, the building size and shape changes, the carousel 22 or 66 construction remains the same.

Referring now to the drawings, and more specifically to FIGS. 6–18, there is shown another version of the improved hangar comprising a building 40, an aircraft support 42, and a ramp 44. Building 40 comprises a generally cylindrical side wall portion 46, a generally conical roof portion 48 resting on the wall portion 46 and closing the top opening 47 thereof, and an annular footing 50 upon which the wall portion 46 rests. Wall portion 46, at one position, has an opening 52 therein which is sufficiently large to move aircraft therethrough and which is selectively closeable by means of a door 53. Annular footing 50 extends under the entire wall portion 46 and ends adjacent to the peripheral boundaries of the opening 52 therein. In registry with the opening 52 and connected to the opposite ends of the footing 50 is a ramp 44. Ramp 44 cooperates with the support 42, and thus, will be described in more detail hereinafter.

Referring specifically to FIGS. 6–11, there is shown the specific construction of building 40. The roof 48 comprises radially extending main roof beams 230, octagonally extending purlins 232 between the main roof beams adjacent the center 234 thereof, secondary roof beams 236 extending radially outwardly from the purlins 232 most distant from the center 234 and the intermediate main roof beams 230, and purlins 208 extending between the radially extending roof beams 230 and 236. Overlaying the roof beams 230 and 236 and the purlins 232 and 208 is the roofing 210 which is preferably provided in sheets which overlay each other adjacent the peripheral boundaries thereof and are secured to the roof beams and purlins 230, 232, 236 and 208. Thus constructed, the roof 48 is secured to both the wall portion 46 adjacent to the periphery thereof and to the post 58 of the turntable or carousel 22.

Referring now to FIG. 1, there is shown the specific manner by which the roof 48 is secured to the top of the post 58. There is shown two of the main roof beams 230 adjacent to the post 58 secured to gusset plates 254 which are in turn welded to the post adjacent to the top end 148 thereof. This securance of the two main roof beams 230 is representative of each of the roof beams 230, and all eight of the roof beams 230 are secured to the post 58 in the same manner to extend radially therefrom. Directly beneath the securance of the gusset plates 254 to the post 58 is the securance of the collar 150 which supports the bearing 154, both of which will be mentioned hereinafter.

Figure 6:
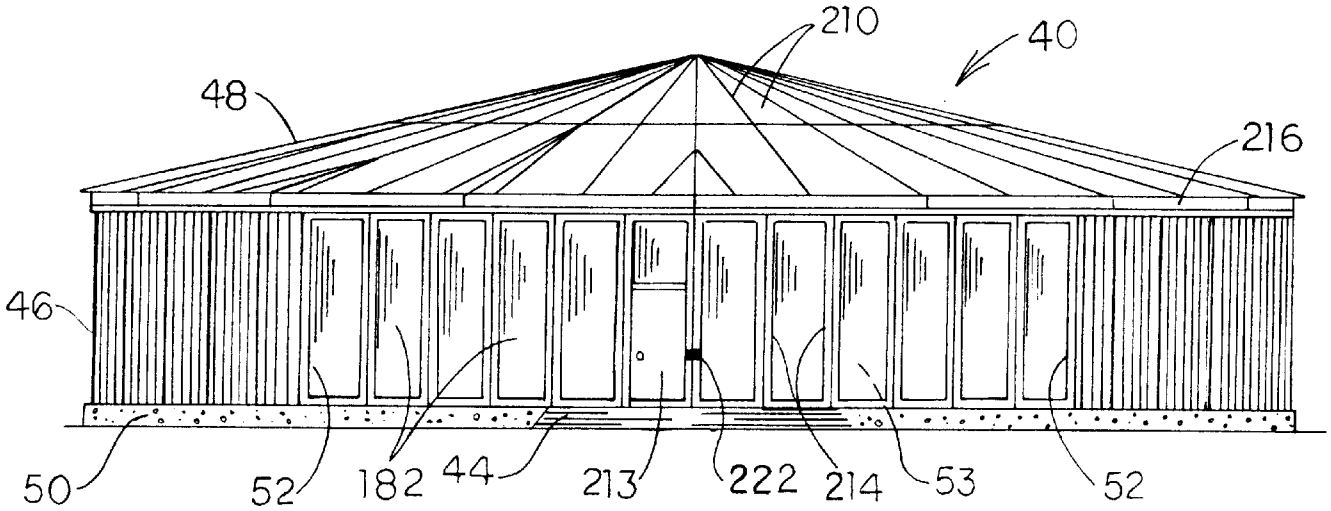
FIG. 6 is a front elevational view of the exterior of one version of the improved vehicle storage building of the invention looking directly at the hangar opening and the door closing the same.
Figure 8:
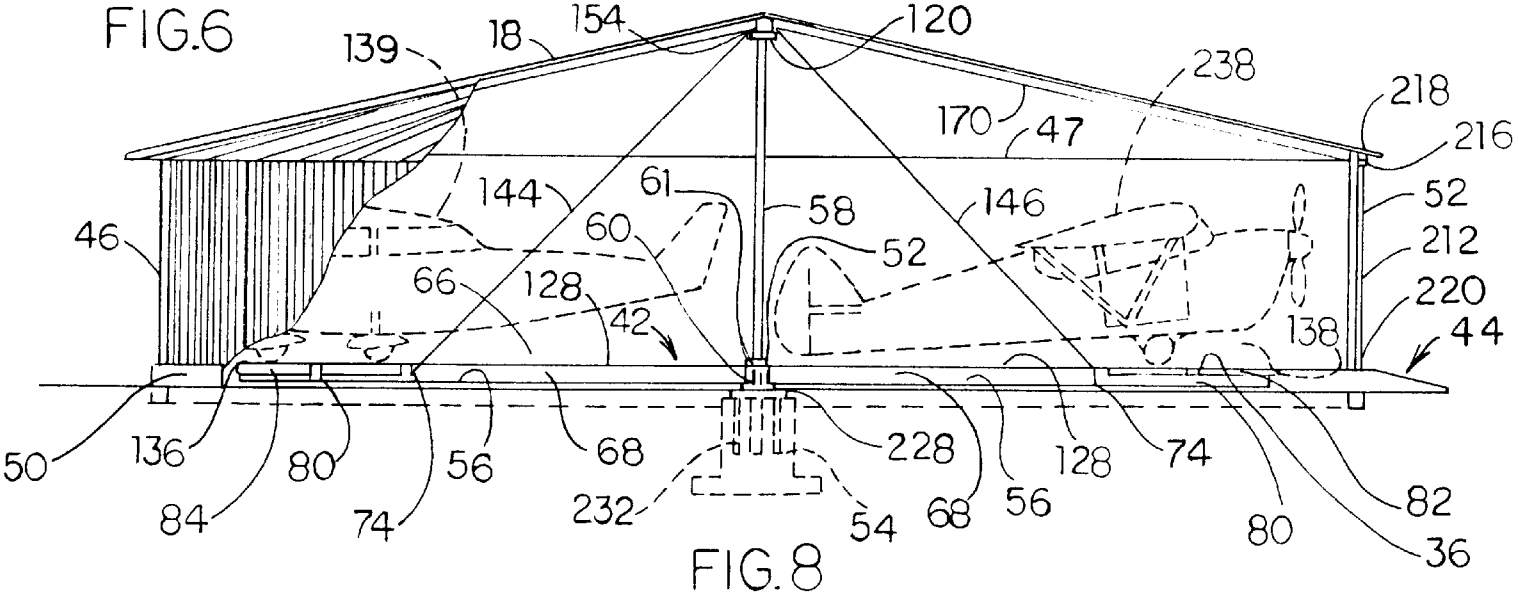
FIG. 8 is a side view, partially broken away, of the new and improved vehicle storage building illustrated in FIGS. 6 and 7, showing the footings, ramp and aircraft support thereof.
Figure 7:
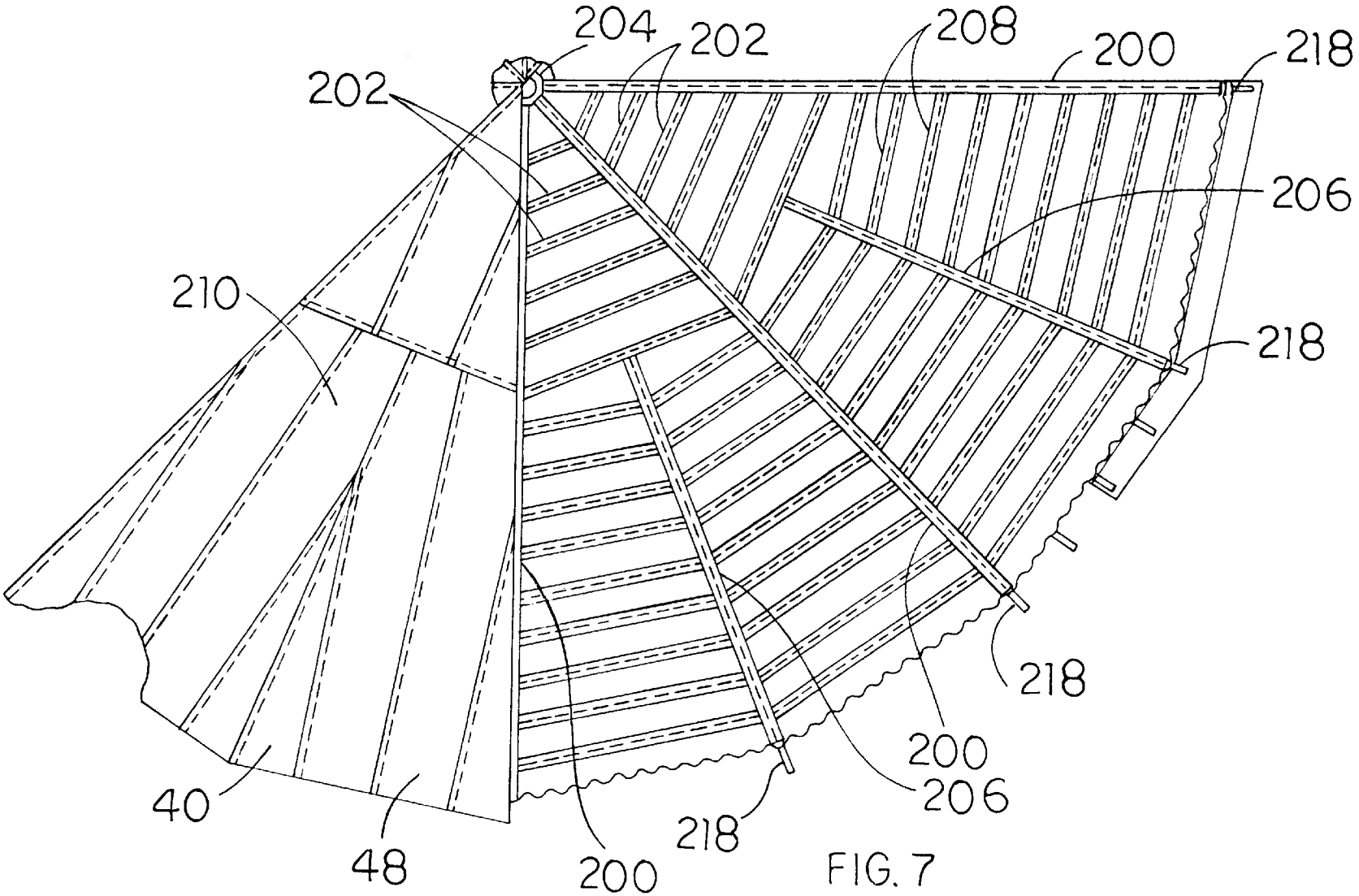
FIG. 7 is a fragmentary and partially broken away top view of the improved vehicle storage building illustrated in FIG. 6 showing primarily the roof construction thereof.

In the specific embodiment illustrated in FIGS. 6–8, door 53 which is provided for selectively closing the opening 52 in the wall portion 46, comprises a plurality of vertically extending elongated panels 212, one of which has a walk door 213 therein, which are hinged together at the longitudinal boundaries 214 thereof, and which together are hung from a door track 216 connected to the overhang 218 of the roof beams 230 and 236 above-mentioned and shown in FIG. 8. Also shown in FIG. 8 is a bottom door track 220 which merely guides the door panels 212 and keeps them vertically disposed. Thus constructed, the door 53 opens in the center 222 thereof and each half of the door 53 rolls on the track 216 into overlaying relationship with the wall portion 46 to uncover the opening 52.

Figure 9:
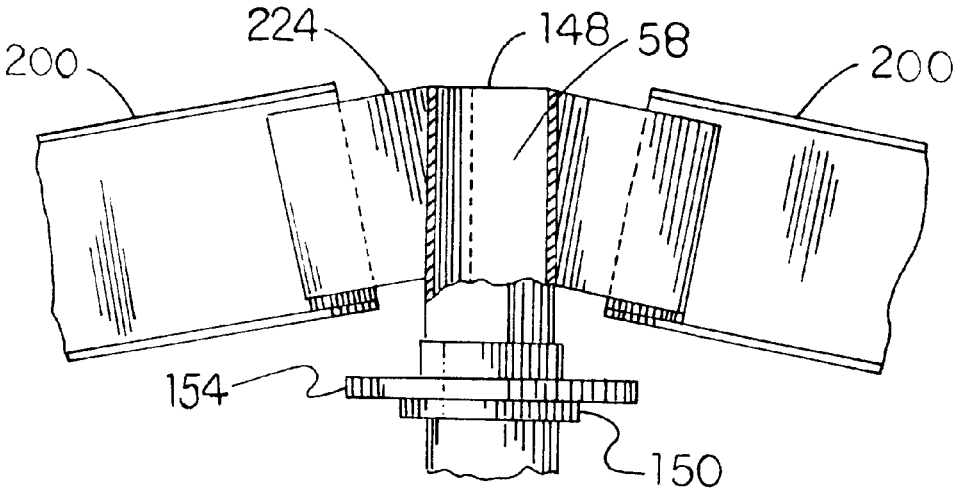
FIG. 9 is an enlarged fragmentary and partially broken away view of the connection between the roof and the vertical post of the new and improved vehicle storage building of this invention illustrated in FIGS. 6–8 and showing the top bearing thereof.
Figure 10:
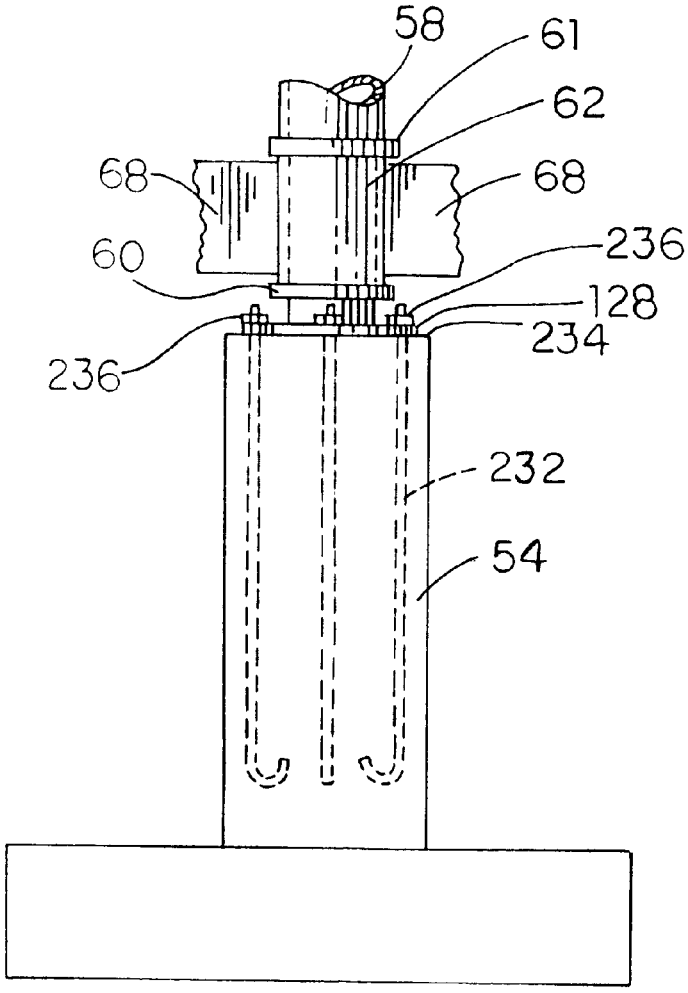
FIG. 10 is an enlarged fragmentary view of the central footing, the vertical post, and the lower bearing of the new and improved vehicle storage building of this invention illustrating the means by which the post is secured to the footing and the aircraft support is secured to the post.
Figure 11:
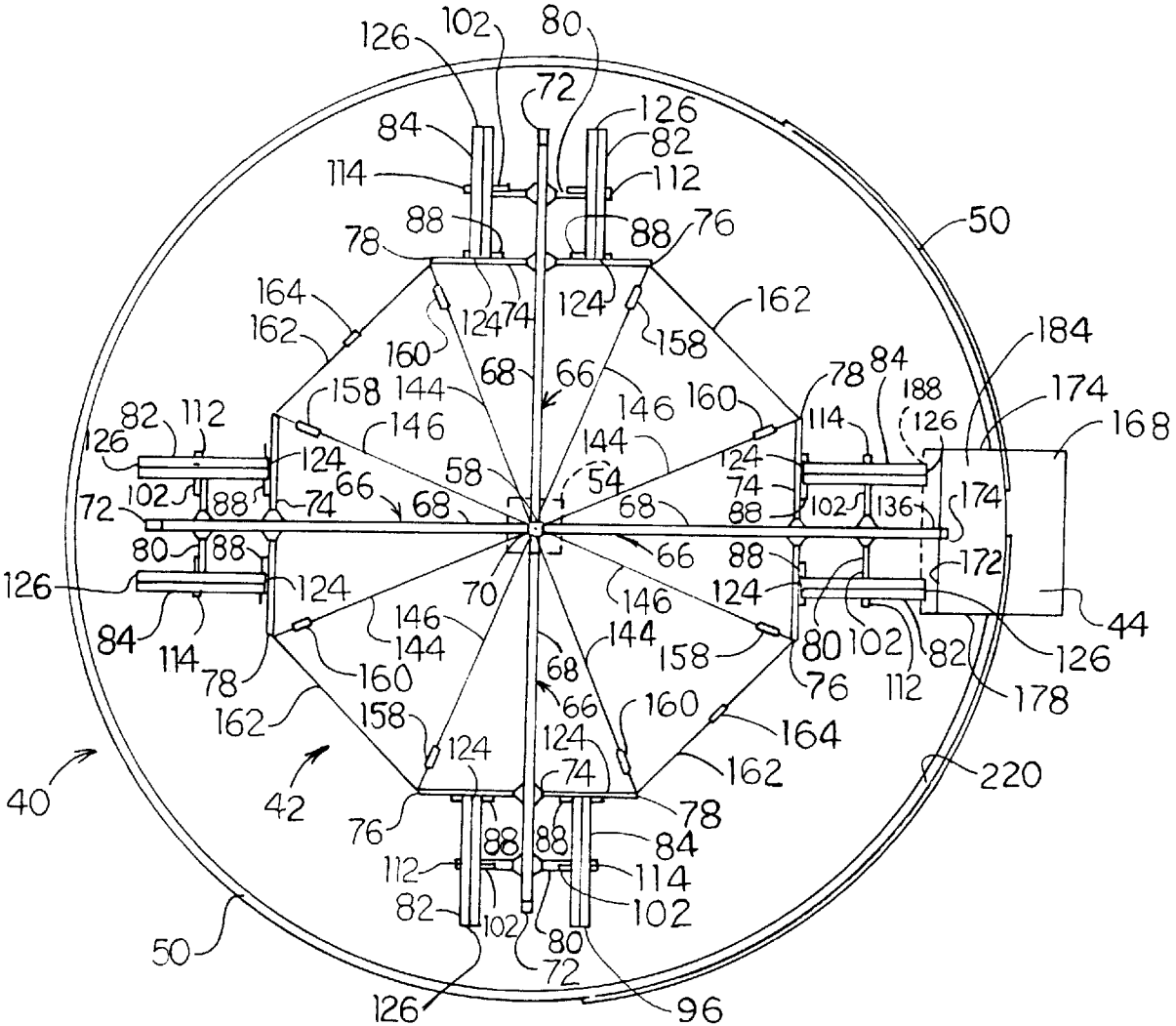
FIG. 11 is a top view of the aircraft support, the ramp associated with the same, and the footing of the new and improved vehicle storage building of this invention illustrated in FIGS. 6–9.

Referring now to FIGS. 8, 9 and 10 and the structure of the aircraft support 42, there is shown a central footing 54 which is embedded in the ground and extends well beneath the frost line. Radially outwardly from the footing 54 the ground is leveled to the level of the top 234 of the footing 54. Secured to the footing 54 to upstand from the footing 54 in a generally vertical position is a rigid post 58. Secured to the rigid post 58 adjacent to the footing 54 is a collar 60. Resting upon collar 60 is a thrust bearing 32 which is rotatable about the post 58 and which is supported by the collar 60 and a spaced apart collar 61.

Referring to FIG. 10, the footing 54 and the method by which the post 58 is secured thereto is shown. A plate 228 is welded to the bottom end 231 of the post 58 generally perpendicular to the axis of the post 58. Plate 228 is in turn secured to the footing 54 by means of a plurality of elongated bolts 233 which are embedded within the footing 54 and extend upwardly from the top surface 234. Plate 228 is positioned on surface 235 and is secured to the footing 54 by means of nuts 237 threadedly secured to the upstanding ends of the bolts 233. This method of attaching the post 58 to the footing 54 provides that the post 58 can be secured to the footing 54 in a manner to extend upwardly in a substantially vertical position since shims (not shown) can be inserted between the plate 228 and the surface 235 of the footing 54 where desired. The substantially vertical securance of the post 58 to the footing 54 is essential to this invention since the support 42 is desirably placed adjacent to the level ground surface 56 and the clearance between the wheel-supporting members 82 and 84 hereinafter mentioned and the ramp 44 is desirably kept as small as possible, and at the same time, the support is desirably rotatable without engaging either the ground surface 56 or the ramp 44.

Secured to the thrust bearing 62 are four aircraft stalls 66 each of which are substantially identical to each other. Thus, a description of one stall 66 will suffice for each other. Aircraft stalls 66 generally comprise an elongated load-bearing member 68 having one end 70 thereof secured to the thrust bearing 62. Member 68 extends from the thrust bearing 62 and the post 58 radially outwardly therefrom thereby defining a distal end 72 thereof. Secured to member 68 intermediate and spaced apart from ends 70 and 72 is a cross-member 74. Cross member 74 is generally perpendicular to member 68 and extends on both sides of member 68 thereby having opposite distal ends 76 and 78. Similarly secured to member 68 is a second cross member 80. Cross member 80 also extends on both sides of member 68, is generally parallel to member 74 and is spaced apart from the intermediate cross member 74 and distal end 72.

Supported by cross members 74 and 80 are a pair of wheel-supporting members 82, 84 which are respectively positioned on opposite sides of and generally parallel to member 68. Wheel supporting members 82 and 84 are channel-shaped and the web portion thereof is perforated to allow moisture from the wheels of the aircraft resting thereon to drain therefrom.

Referring now to FIGS. 12–15, the specific manner by which the members 82 and 84 are supported will be described. Since the structure supporting both members 82 and 84 are identical a description of one will suffice for the other. Secured to the surface 86 of the cross member 74, which faces the cross member 80, is an angle-support 88 having an upwardly facing flange surface 92 upon which cross members 82 and 84 rest adjacent to ends 124. Support 88 is positioned with respect to the top surface 90 of the member 74 such that the wheel-supporting members 82 and 84 when resting upon the flange surface 92 of the support 88 will be flush with the surface 90. A rectangular notch 100 is provided within the web portions 94, 96 and 98 in which the top portion of cross member 80 fits. Notch 100 is slightly larger than the cross-sectional size of member 80 thereby preventing the members 82 and 84 from moving off of the support 88. Thus positioned on the support 88 and the member 80, the weight of the members 82 and 84 are slideable along the member 80 and support 88 toward and away from member 68 in order to accommodate the main gear of any particular aircraft. For this reason, the support 88 is provided with a length measured axially of the member 74 which is substantially greater than the width dimension of the members 82 and 84. The weight of members 82 and 84, however, is sufficient to prevent any unintended movement of the type above-described.

Still referring to FIGS. 12–15, there is shown the means by which the wheel members 82 and 84 adjacent to the periphery of the support 42 can be selectively raised and lowered. This adjustment in the elevation of the wheel-supporting members 82 and 84 and the distal ends 126 thereof is provided by inserting an angle member 102 having generally the same length as the supports 88 between the member 80 and each of the members 82 and 84. More specifically, the angle member 102 has two flange portions 104 and 106. Flange portion 104 is positioned to overlay a portion of the top surface 108 of the member 80 and the flange portion 106 is positioned to overlay a portion of the side surface 110 which faces outwardly and away from member 74. Both flanges 104 and 106 of member 102 are positioned within the notch 100 of the wheel-supporting members 82 and 84. Secured to the flange 106 of each of the members 102 adjacent to the opposite ends 112 and 114 of the member 80 is a nut 116. Nut 116 is positioned in registry with an opening not shown. Threadedly positioned within the nut 116 is a bolt 118 which can be threadedly moved within nut 116 and through the opening within the flange 106 to abut the end of its stud portion 120 against the side surface 110 of the member 80. When stud portion 120 is abutted against surface 110 of member 80, the angle 102 is cocked in the manner illustrated in FIG. 14 such that the angle 102 forcedly bends the members 82 and 84 adjacent to notch 100 thereby elevating the distal ends 126 thereof. The end 124 of the member 82 and 84 which is adjacent the member 74 and supported by the support 88 remains stationary. Since the distal ends 126 of the members 82 and 84 are elevated a distance proportionally greater than the elevation of the member 82 and 84 adjacent to member 80, distal ends 126 of each of the members 82 and 84 can be raised and lowered a distance sufficient to adjust the elevation of the distal ends 126 as required by selectively adjusting the bolt 118 a relatively small amount.

Secured to the member 68 and extending the entire length thereof is an elongated channel-shaped member 128. Member 128 has its flange portions 130 and 132 upstanding from the member 58 so as to define a continuous upwardly facing groove 134 extending the entire length of the member 68 and radially outwardly of the post 58. Groove 134 at one end is closed by the post 58 and at the other end is closed by a prism-shaped chock or abutment member 136 which is pivotally connected to the distal end 72 of the member 68 by means of a rod 138. Thus connected to the member 68, the chock 136 can be moved between the two positions 140 and 142 shown in FIG. 16. The precise function of the chock 136 in positions 140 and 142 will be mentioned hereinafter.

Thus constructed, each of the stalls 66 of the turntable 42 is adapted to receive an aircraft thereon. Member 82 and 84 are adjustable to be placed in registry with and to support he main gear of the aircraft. And, channel-shaped member 128 is equipped to receive either a nose or tail wheel, as the case may be, within the groove 134. Groove 134 functions to place the aircraft in registry with the member 82 and 84 each time the aircraft is placed upon the stall 66 once the adjustment of the members 82 and 84 has been made.

The stalls 66 are further supported by the post 58 by means of guy wires 144 and 146. Secured to the post 58 adjacent to the top 148 thereof is the collar 150 having an annular flange 152 extending generally perpendicularly from the post 58. Positioned over the collar 40 and resting on the flange 152 is a bearing ring 154 having openings 156 therein. Guy wires 144 and 146 extend between the ring 154 and the opposite ends 76 and 78 of the member 74, respectively of each of the stalls 66. Specifically one end of the guy wires 144 and 146 is secured to the ring 154 by means of the openings 156 and the other ends of the wires 144 and 146 are secured to the ends 76 and 78 of the member 74 by means of anchors 157. Intermediate the ends of the wires 144 and 146 are positioned, respectively, turn buckles 158 and 160 by which the length of the wires 144 and 146, respectively, can be selectively adjusted so as to minimize the moment about bearing 62.

Further, each of the stalls 66 is guyed to the adjacent stalls 66 by means of guy wires 162 extended between end 78 of member 74 of one stall 66 and end 76 of member 74 of an adjacent stall 66. Intermediate the opposite ends of the guy wires 162 are positioned turn buckles 164 for selectively adjusting the length thereof to insure that the load bearing members 68 extend from the bearing 62 substantially radially therefrom thereby to minimize strain within the connection between the bearing 62 and the members 68.

Alternatively, each individual aircraft stall 66 may be supported from the floor or ground 20 by wheels 300 journaled in bearings in either beam 80 adjacent its ends 82, 84, respectively, as desired. Only two wheels 300 are necessary to support each stall 66. Supported in this manner, the post 58 need only to be tall enough to encompass the journal or bearing 62 and need not extend any higher than the top of the member 68. Thus, guy wires 114 and 116 extending between the collar 120 and the distal ends 76, 78 of member 74 are also unnecessary as the stall 66 fully supported by the bearing 32 about post 28 and the journaled wheels 300 in members 80 as desired.

A modified aircraft stall 66 is shown in FIG. 19 to include exterior members 302 extending between the journal 62 around post 58 and the distal ends 82, 84 of member 80 on which the wheels 300 are journaled. In the embodiment shown in FIG. 19, the exterior members 302 provide the rigidity to the aircraft stall 66 which is provided by the guy wires between adjacent stalls 66 above described and by guy wires 114, 116 when the stalls 66 are supported by post 28. In all versions of the new and improved vehicle storage building of the invention, the stalls 26, 66 shown in FIGS. 12 and 19 are interchangeable as desired.

Thus, constructed, the individual aircraft stalls 26, 66 are connected together and form the aircraft support or turntable 42 which has a construction similar to a carousel 22 and is rotatable about the axis of the post 58. Turntable 42 being generally horizontal is spaced from the ground and unsupported from the ground radially outwardly from the post 58. However, during the positioning of an aircraft on a stall 26, 66 for the unloading of an aircraft therefrom, the turntable 42 is desirably prevented from rotating. This is achieved by an interaction between the turntable 42 and the ramp 44.

Referring now to FIGS. 6, 8,11,12, 16 and 17, ramp 44 is shown to have an upwardly facing surface 168 which generally is at the same elevation as the button of the groove 134, of the channel-member 128. Adjacent to the peripheral boundary of the turntable 42, ramp 44 has a step 170 which is at an elevation below surface 168. Formed in the ramp 44 adjacent to the upstanding step surface 172 and communicating with both surface 168 and 172 is a groove 174. Groove 174 is centrally located between the opposite ends 176 and 178 of the ramp 44 and extends longitudinally thereof.

During the loading or unloading of an aircraft from a stall 66, the stall 66 is placed in registry with the ramp 44 and locked in that position by moving chock member 136 from the position 140 into the position 142 in which a portion thereof is positioned within the groove 174. With the member 136 in the position 142 within groove 174, turntable 42 is not free to rotate about post 58 and is maintained in registry with the ramp 44. Further, wheel-supporting members 82 and 84 which extend beyond the distal end 72 of the member 68 extend into overlaying relationship with upwardly facing step surface 170. However, both members 82 and 84 if properly adjusted by the means illustrated in FIGS. 13 and 14 and above-described, clear both the surface 170 and the upstanding surface 172 of the ramp 44. However, whenever the major portion of the aircraft in the stall 36 bears upon the wheel-supporting members 82 and 84 intermediate the cross member 80 and the distal ends 126 thereof, members 82 and 84 will be supported by the surface 170. While the upwardly facing surface 110 of the chock member 136 when in the position 142 bridges the gap between the distal end 72 of the member 68 and the surface 168, no such member need be connected to the wheel 22 supporting members 82 and 84 to bridge the gap between the distal ends 126 and the surface 168 as the wheels of the main gear of the aircraft are sufficiently large enough to bridge the gap therebetween.

Figure 18:
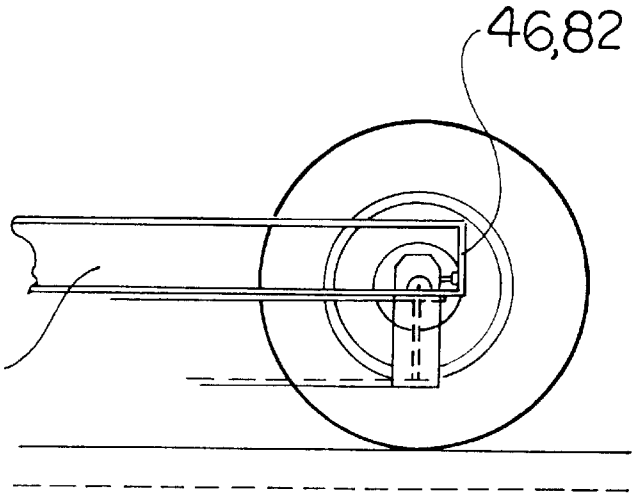
FIG. 18 is a fragmentary side elevaltional view of a modified version of the new and improved vehicle storage building of the invention using the same aircraft support and associated ramp structure as shown in FIGS. 6–12.

Referring now to the modified version of the improved hangar of this invention illustrated in FIGS. 18 and 19 there is shown a building 191 having at least one side 194. In this embodiment, a carousel 22 having only a single airplane stall 66 is supported at journal 62 and at the opposite ends of members 310 by wheels 300. This stall 66 may be used in any of the versions illustrated in FIGS. 2, 3 and 5. Additionally, multiple stalls 66 may be utilized of the construction shown in FIGS. 18 and 19 by extending guy wires between adjacent stalls 66.

In a specific construction of this invention, the buildings 10, 29, 31, 40 and 191 can be of conventional construction, i.e. the footings 50 and 54 and the ramp 44 can be of poured concrete, the beams 230 and 236, and the purlins 232 and 208 can be made from any rigid, self-supporting and load-bearing material from which structural members can be formed, and the roofing 210, the doors 53 and their accompanying hangars 216 and guides 220, and the upstanding side portions 46 can all be of conventional materials and design. Further, certain portions of the turntable 22 can be of conventional construction. For example, the post 58, and the members 68, 74, 82, 84, 88 and 102 can all be made of any rigid, self-supporting and load-bearing material from which structural members can be formed. Similarly, collars 60 and 61, bearing 62, collar 150 and bearing-ring 154, guy wires 144, 146 and 162 and their anchors 157, and turnbuckles 158, 160 and 164 can be all of conventional materials and design. Members 128, 135 and 184 can be made of any rigid and self-supporting material, however, these materials must be chosen together with materials from which post 58 and the members 68, 54, 80, 82, 84, 88 and 102 are made such that the post 58 and each of the members have a strength required to support the aircraft stored on the turntable 42 during use of the hangar of this invention.

Further, in any specific construction of this invention, the dimensions of the hangar 10, 30, 31, 41 and 191, the turntables 22, and the footings 50 and 54 and the ramp 44 associated therewith are determined by the dimensions of the aircraft intended to be stored within the hangar. Thus, each specific construction of the improved hangar of this invention will vary in dimension and as the aircraft stored in the hangar become larger, the strength required for each of the load-bearing parts, members of beams of the structure above-described will have to be increased, in a manner well known to engineers, architects and builders of similar buildings or structures.

In operation, the improved hangar utilizes hangar space at least as efficiently as conventional T-type hangars and permits each of the aircraft stored within the hangar to be positioned within and removed from the hangar through the same opening 52 and without requiring the moving of adjacent aircraft. Thus, the improved hangar of this invention minimizes the number of doors 53 required for each hangar and minimizes the taxi strip required to connect the hangar to the runway of an airport. All this is achieved by providing a turntable 22 upon which aircraft can be stored. Turntable 22 can be revolved so as to place each of the aircraft stored thereon in registry with the opening 52 of the hangar, and thus, each of the aircraft stored on the turntable 22 can be removed from the hangar nose first through the same opening. Further, the turntable can be revolved so as to place each of the aircraft stored thereon in registry with the opening 52 of the hangar, and thus, each of the aircraft stored on the turntable 22 can be removed form the hangar nose first through the same opening. Further, the turntable 22 being circular in shape, allows each of the aircraft to be positioned on the turntable 22 with its tail portion adjacent to the center of the turntable 22 thus permitting the aircraft to be removed from the hangar nose first. At the same time, the hangar construction of this invention utilizes the space of the turntable 22 as efficiently as a conventional T-type hangar.

The construction of the turntable 22 is unique in the respect that it is supported only at its center and is unsupported from the ground at all positions radially outwardly from the center of the turntable 22. Thus suspended, the turntable 22 is unaffected by the condition of the ground surface 56 or the freezing and thawing thereof. So long as the footing 50 and 54 function to maintain the post 58 in a substantially vertical position and the ramp 44 stationary, the turntable 22 will remain free from operational difficulties. Even if the post 58 becomes substantially out of a vertical position or the ramp 44 is heaved out of position by frost or otherwise that the turntable 42 binds and is riot freely rotatable, correction of this difficulty simply involves readjusting the elevation of the wheel-supporting members 82 and 84 by the means illustrated in FIGS. 13 and 14 or placing additional shims between the plate 208 and the footing 54 to reposition the post 58 in the desired vertical position. Thus, the improved hangar of this invention is not only relatively maintenance free, but when maintenance is required the maintenance is facilitated by the relatively simple construction thereof.

When positioning a conventional gear aircraft 238 onto one of the stalls 66, the turntable 22 is rotated until an empty stall is in registry with the ramp 44 and the chock member 136 is rotated into the position 142 locking the stall 66 in position. The aircraft 238 can then be merely pushed or pulled onto the stall 66. More specifically, the tail wheel of conventional gear aircraft is positioned within the channel member 134 and the aircraft is moved onto the stall 66 until the main gear are adjacent the upstanding surface 72 of the ramp 44. In this position, the wheelsupporting members 82 and 84 are adjusted in position longitudinally of the member 80 so as to be in registry with the wheels of the main gear. Then the aircraft 238 is moved the rest of the way onto the stall 66 and into a position such as that illustrated in FIG. 8 in dashed lines. Once the aircraft is assigned to a specific stall 66 and the wheel-supporting members 82 and 84 are adjusted to be in registry with the main gear of the aircraft no further adjustment is necessary.

The aircraft 238 being positioned on the stall 66, the member 184 is moved into the position 186 and the chock member 136 is moved into the position 140 thereby rendering the turntable 42 free to rotate in order to place another stall 66 in registry with the ramp 44. Chock member 136 in position 140 closes the distal end 72 of the member 134.

When an aircraft 239 having tricycle gear is placed upon a stall 66, the aircraft will still be positioned such that the tail portion of the aircraft is adjacent to the post 58 and the nose portion of the aircraft adjacent to the periphery of the turntable 22. In this position the nose gear of the aircraft will be adjacent to the distal end 72 of the members 68 and 128. In this position, the chock member 136, in the position 140 functions as an abutment member for the nose gear of the aircraft. Chock member 136 closes the distal end 72 of the groove 134 of the member 128 and prevent the nose gear of the aircraft from moving beyond the distal end of the member 128 and from the turntable 22 when not desired.

Figure 17:
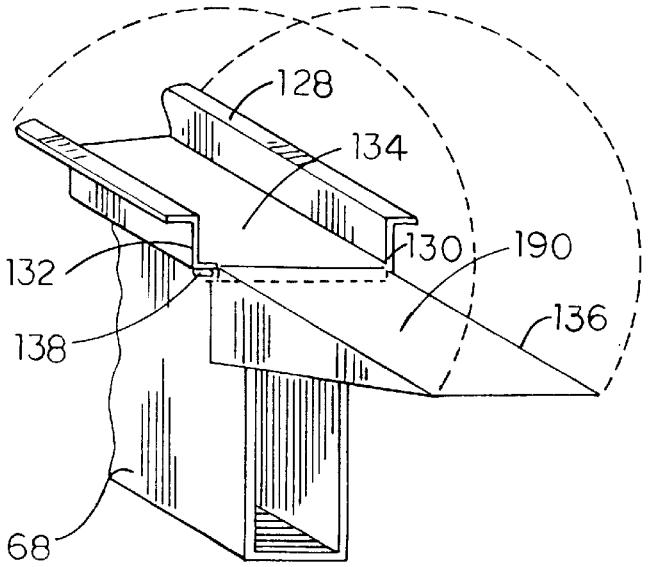
FIG. 17 is an enlarged fragmentary and perspective view of the load-bearing member of one of the aircraft stalls of the aircraft support illustrating the locking means illustrated in FIG. 16.
Figure 16:
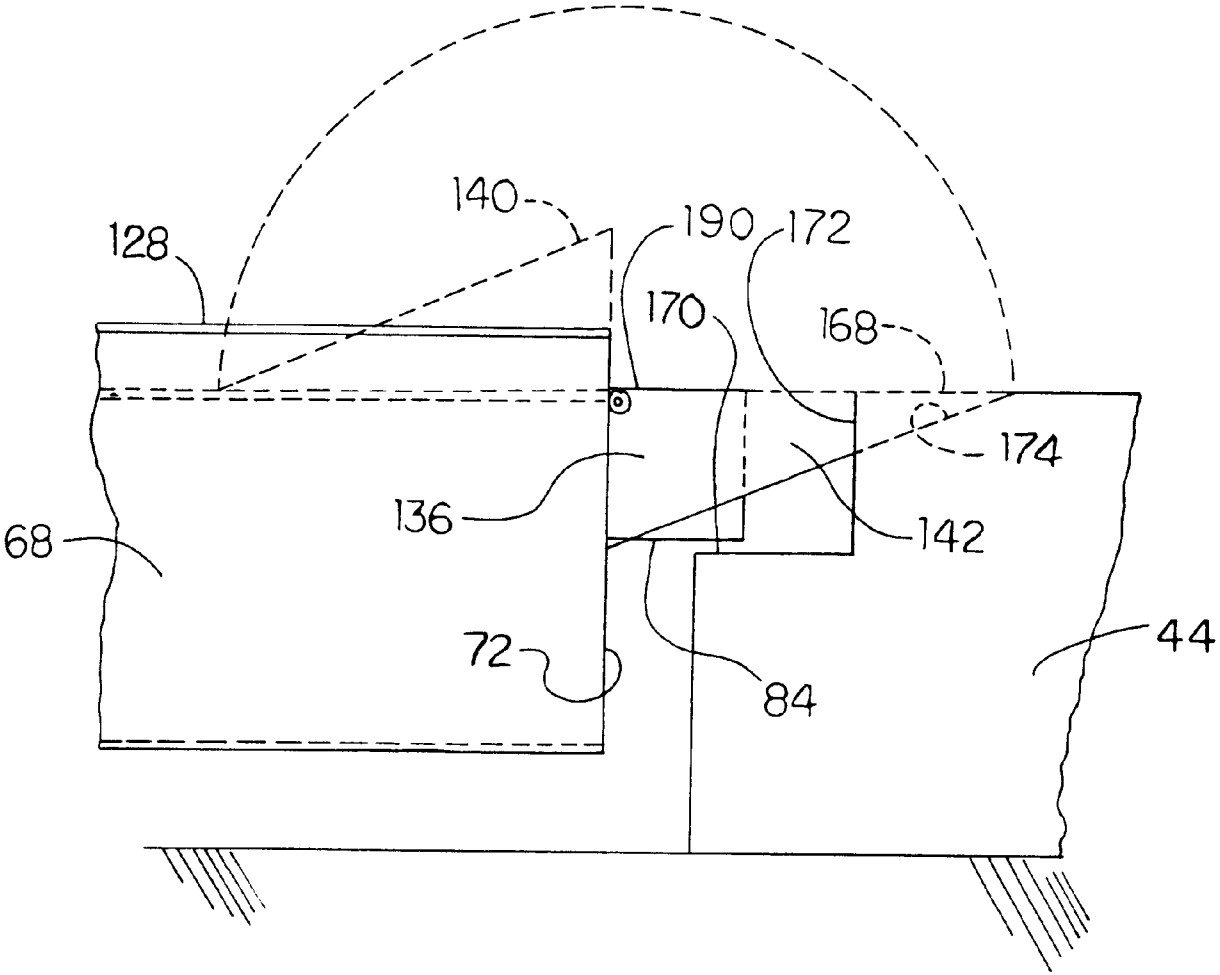
FIG. 16 is a fragmentary view of the aircraft support and the ramp associated therewith illustrated in FIGS. 8–15 showing the load-bearing member of one of the aircraft stalls of the support in registry with the ramp and illustrating the means by which each stall of the support can be locked in loading or unloading position.

FIGS. 12,17 and 19 shows a carousel 22 having a single stall thereon. FIG. 12 shows the carousel completely supported by the footing 54 and the post 58. FIGS. 17 and 18 illustrates a carousel not supported by the post but supported by wheels 300 having tires thereon secured to the radially extending outward support beams 302 of the stall.

The improved hangar construction of this invention above described provides an improved aircraft storage device which can be inexpensively made and constructed and which is relatively maintenance free during use. The hangar of this invention also utilizes hangar space at least as efficiently as the convention T-type hangars and permits each of the airplanes stored within the hangar to be positioned and removed from the hangar through openings in the same side of the hangar, and without moving the aircraft within the hangar. This permits the hangar of this invention to be backed up to a peripheral boundary of the property on which the hangar is located or to other buildings and provides that a minimum of doors and taxi strip is required for each hangar building made in accordance with this invention.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A vehicle storage building having upstanding side walls and a single door opening providing access to the interior of said building, said building having an upwardly facing and generally planar interior vehicle support surface on which vehicles may be stored and a turntable adjacent said door opening having at lease one vehicle stall thereon flush with said vehicle support surface within said building, said building having both said one stall on said turntable and a plurality of storage positions within said building remote from said turntable from which stored vehicles may be taken from or delivered to said storage positions by way of said turntable through said door opening without repositioning any of the other vehicles within said building.

2. The vehicle storage building of claim 1 wherein said turntable has a plurality of vehicle stalls thereon.

3. The vehicle storage building of claim 1 wherein said turntable has four vehicles stalls thereon.

4. The vehicle storage building of claim 1 wherein said building has a taxi strip extending from said floor through said door.

5. The vehicle storage building of claim 1 wherein said floor has seven storage positions remote from said turntable whereby said storage building has a capacity of ten vehicles.

6. The vehicle storage building of claim 1 wherein said building has four storage positions whereby said building has a capacity of seven airplanes.

7. The vehicle storage building of claim 1 wherein said building has a maintenance or storage area therein, said maintenance or storage area being remote from said door opening, said turntable separating said door opening from said maintenance or storage area.

8. The vehicle storage building of claim 1 wherein said stalls may be generally aligned with each of said storage positions, whereby each of said storage positions can be loaded or emptied without moving other vehicle in said vehicles storage building.

9. The vehicle storage building of claim 1 wherein said turntable has five vehicles stalls thereon.

10. The vehicle storage building of claim 1 wherein said turntable is generally horizontal and supported flush with said floor, said turntable being adapted to receive an vehicle thereon, said turntable being rotatable such that said vehicle stall thereon can be placed in more than a single position, said stall having an elongated, load bearing member, said load bearing member extending radially outwardly from the center of said turntable, two wheel supporting members secured to said load bearing member adjacent the periphery of said turntable, said wheel supporting members being spaced from and on opposite sides of said load bearing member, respectively, said wheel supporting and load bearing members being adapted to support a vehicle thereon.

11. The vehicle storage building of claim 10 wherein said turntable pivots about a central post, said post being secured to said ground extending vertically upwardly.

12. The vehicle storage building of claim 10 wherein the periphery of said turntable is connected to the top of said post adjacent the top thereof, whereby said turntable is totally supported by said post.

13. The vehicle storage building of claim 10 wherein the periphery of said turntable is supported by wheels secured to said load bearing member, said turntable being supported by said post and said wheels.

14. The vehicle storage building of claim 10 further comprising a support member secured to said load bearing member intermediate the opposite ends thereof extending outwardly on both sides of said load bearing member and a cable extending from the distal ends of said load bearing member to the top of said post.

15. The vehicle storage building of claim 10 wherein there are a plurality of airplane stalls on said turntable, each of said stalls having an elongated load bearing member connected to said post and extending radially outwardly from said post, each of said load bearing members having a structural member secured to said load bearing member between its opposite ends and extending outwardly of said load bearing member on both sides thereof and a cable extending between the top of said post and both distal ends of said structural member.

16. The vehicle storage building of claim 10 wherein there are a plurality of airplane stalls on said turntable, each of said airplane stalls having an elongated load bearing member connected to said post and extending radially outwardly therefrom, a wheel secured to each of said load bearing members adjacent its distal end, said wheels and said post supporting said load bearing member, said wheels and said post supporting said turntable.

17. The vehicle storage building of claim 10 wherein there are from about one to about five airplane stalls on said turntable and each of said stalls having one of said wheels associated therewith, said turntable being totally supported at said post and by said wheels.

18. The vehicle storage building of claim 10 wherein said storage positions are each generally remote from said turntable in a radial direction therefrom adjacent to the peripheral walls of said building, said storage positions being defined to place said vehicle adjacent said building walls.

* * * * *